United States Patent [19]

Thomas

[11] Patent Number: 4,513,462

[45] Date of Patent: Apr. 30, 1985

[54] THERAPEUTIC PILLOW

[76] Inventor: Charles R. Thomas, 9696 Northlawn, Detroit, Mich. 48204

[21] Appl. No.: 555,498

[22] Filed: Nov. 28, 1983

[51] Int. Cl.[3] ..... A47G 9/00

[52] U.S. Cl. ..... 5/442; 5/434

[58] Field of Search ..... 5/434, 435, 436, 437, 5/442, 441, 440

[56] References Cited

U.S. PATENT DOCUMENTS

| | | | |
|---|---|---|---|
| D. 214,302 | 6/1969 | Barber | 5/434 |
| 3,276,046 | 10/1966 | Capelli | 5/436 |
| 3,443,267 | 5/1969 | Schuckman | 5/442 |
| 3,795,021 | 3/1974 | Moniot | 5/442 |

FOREIGN PATENT DOCUMENTS

| | | | |
|---|---|---|---|
| 3138463 | 4/1983 | Fed. Rep. of Germany | 5/434 |
| 2305956 | 10/1976 | France | 5/434 |
| 2424008 | 11/1979 | France | 5/434 |

*Primary Examiner*—Alexander Grosz

*Attorney, Agent, or Firm*—Cullen, Sloman, Cantor, Grauer, Scott & Rutherford

[57] ABSTRACT

A therapeutic pillow comprises a soft resilient bottom pillow section and a top pillow section thereover and peripherally interconnected. The top section includes top and bottom fabric covers peripherally interconnected with interior stitching spaced from the sides of the pillow sections interconnecting the covers defining a first tubular neck support of rectangular shape and a supplemental neck support of U-shape. Compacted resilient fiber stuffing is interposed within the neck supports. The bottom section includes a bottom fabric cover peripherally joined to the top section containing a mass of loosely confined resilient fiber stuffing which underlies the top pillow section.

10 Claims, 5 Drawing Figures

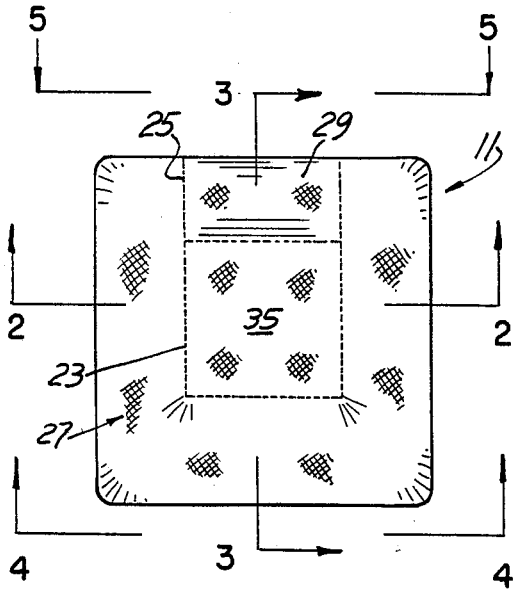

THERAPEUTIC PILLOW

BACKGROUND OF THE INVENTION

1. Field of Invention

The present invention is directed to pillows and more particularly a therapeutic pillow which has a soft and resilient central section and a peripheral firm neck support section.

2. The Prior Art

Heretofore various efforts have been made to provide a pillow which provides a firm neck support and at the same time a soft yielding head support. Illustrations of such prior art efforts are shown in one or more of the following U.S. Pat. Nos:

| NUMBER | NAME | DATE |
|---|---|---|
| 35,947 | C. W. Meinecke | December 31, 1901 |
| 1,020,444 | S. L. Platt | March 19, 1912 |
| 3,400,413 | E. La Grossa | September 10, 1968 |
| 3,521,310 | M. H. Greenawalt | July 21, 1970 |
| 3,667,074 | William M. Emery | June 6, 1972 |
| 3,829,917 | Earle W. De Laittre | August 20, 1974 |
| 3,902,456 | Mildred M. David | September 2, 1975 |
| D238,104 | Samuel L. McNair | December 16, 1975 |
| 4,320,543 | Linda H. Dixon | March 23, 1982 |

The difficulties with prior art pillow constructions were that some neck supports were provided with a hardened latex material with the head support of a soft resilient latex material. A plurality of different types of firm materials were provided to define a neck support as well as a head support including unit molded pillows having a central section to receive the head and with peripheral portions for supporting the neck. The contoured pillows in the prior art essentially were difficult to assemble. Pillow assemblies had a central opening for the head and peripheral portions to supportably receive the neck.

SUMMARY OF THE INVENTION

An important feature of the present invention is to provide a therapeutic pillow which has a resilient fluffy bottom pillow section and an upper pillow section and wherein peripheral tubular portions thereof are filled with a compacted resilient fibrous material to define a firm neck support.

Another feature is to provide a therapeutic pillow which consists of bottom and top sections with the top section having a top and bottom fabric covers which are peripherally interconnected and which include additional rectangular stitching inwardly of the sides of the covers, which centrally interconnects the covers and which defines a first tubular firm neck support of rectangular shape and a supplemental tubular neck support of U-shape. Both neck supports are filled with snugly compacted resilient fiber.

Another feature includes the top pillow section overlying a bottom pillow section which includes a second bottom fabric cover spaced from the bottom fabric cover of the top section defining a chamber which underlies the top pillow section and within which is loosely confined resilient stuffing of a fibrous material underlying the top pillow section.

An important feature includes within the top section, a series of peripheral portions which are of a tubular construction and within which compacted resilient stuffing is positioned and retained to define a firm neck support. The top section overlies and is peripherally secured to the bottom section which simulates the conventional soft resilient pillow. The bottom pillow section has only a bottom cover thereon, with a soft resilient stuffing of a fibrous material within the bottom section underlying and in engagement with undersurface portions of the bottom cover of the top pillow section.

An important feature further includes a centrally disposed resilient and soft head support which is in direct overlying engagement with the soft resilient bottom section of the therapeutic pillow.

These and other features and objects will be seen from the following Specification and claims in conjunction with the appended drawings.

THE DRAWINGS

It will be understood that the above drawing illustrates merely a preferred embodiment of the invention and that other embodiments are contemplated within the scope of the claims hereafter set forth.

DETAILED DESCRIPTION OF AN EMBODIMENT OF THE INVENTION

Figure 1:
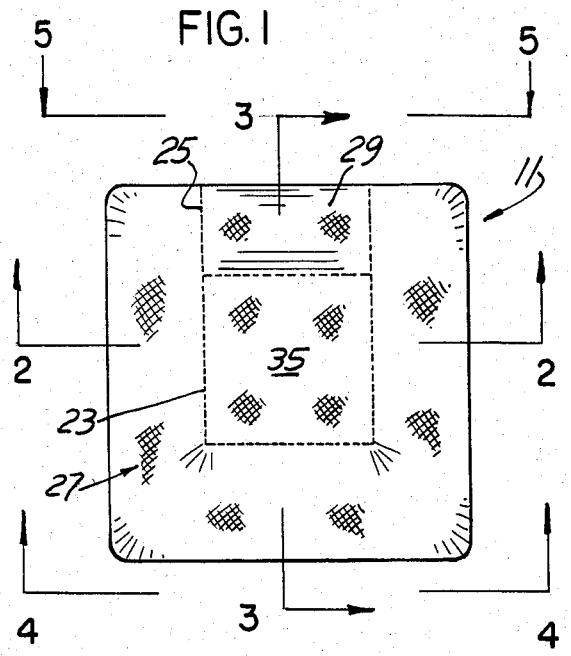
FIG. 1 is a plan view of the present therapeutic pillow.
Figure 2:
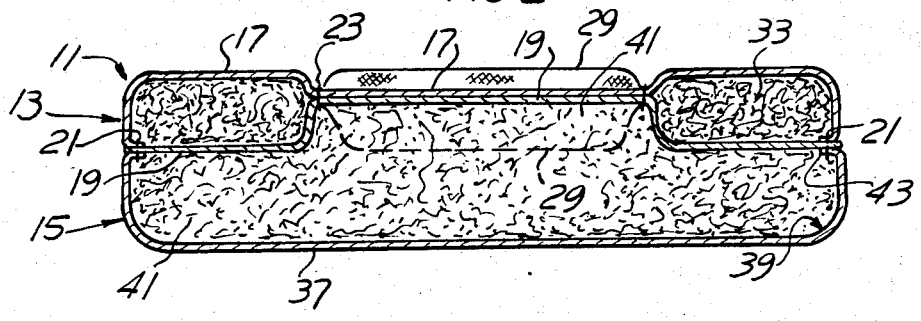
FIG. 2 is a section taken in the direction of arrows 2—2 of FIG. 1 on an increased scale.
Figure 4:
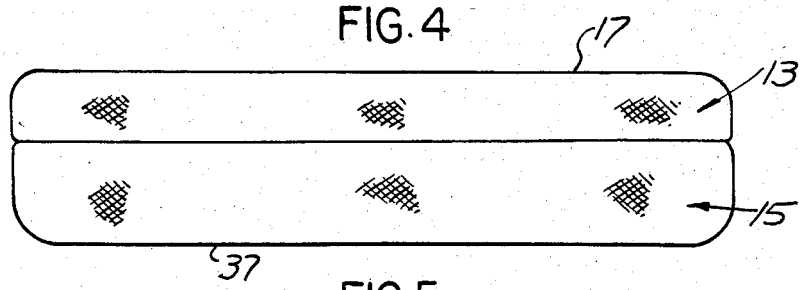
FIG. 4 is a side view taken in the direction of arrows 4—4 of FIG. 1 on an increased scale.

Referring to the drawing, the present therapeutic pillow 11, FIG. 1, includes top pillow section 13 and bottom pillow section 15 peripherally interconnected as shown in FIG. 2. The top pillow section snugly overlies the bottom pillow section.

Figure 3:
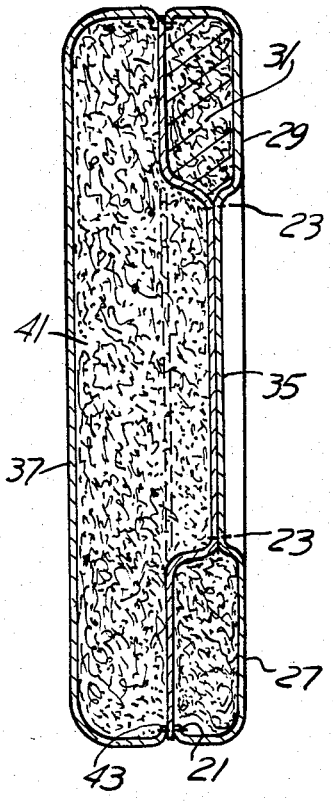
FIG. 3 is a similar section taken in the direction of arrows 3—3 of FIG. 1.

The top pillow section includes top fabric cover 17 of a suitable material which may be plain, ornamented as desired or have an attractive design and a plain bottom fabric cover 19. Covers 17 and 19 are interconnected by the first peripheral stitching 21, FIGS. 2 and 3.

Inner rectangular stitching 23, preferably square, is spaced inwardly of the corresponding sides of the assembled pillow sections and interconnects the cover 17 and first bottom cover 19, as in FIG. 2, with portions of the covers upon the interior of the rectangular stitching 23 being in surface engagement.

Additional end stitching 25 extends from one side of the rectangular stitching 23 to one corresponding side of the assembled pillow sections, FIG. 1. The first peripheral stitching 21, the rectangular stitching 23 and the end stitching 25 define within the top pillow section and between the covers 17 and 19, the elongated rectangular tube 29. Said tube is exteriorly and transversely convex, defining a firm neck support. Compacted resilient fiber 31, such as a polyester fiber, cotton, down or feathers is snugly nested and retained within neck support 29, sometimes referred to as the first neck support.

The U-shaped tube 27 defined by first peripheral stitching 21, rectangular stitching 23 and the extension stitching 25 has confined therein a similarly compacted fiber, such as polyester fiber, for illustration. In the illustrative embodiment, the compacted fiber 33 within the U-shaped supplemental neck support 27 may be similarly or less compacted, but nevertheless provides a firm neck support.

The area of the top pillow section within the rectangular stitching 23 defines with the bottom pillow section 15, a soft resilient headrest 35.

The bottom pillow section 15 includes a single fabric second bottom cover 37 which generally underlies and is spaced from the first bottom fabric cover 19 to define rectangular chamber 39. The second bottom cover 37 is peripherally connected to the top pillow section 13 by the second peripheral stitching 43, FIG. 2.

A stuffing 41 of a non-compacted fiber, such as polyester fiber, cotton, down or feather is confined and loosely retained within chamber 39 so as to completely underlie the top pillow section 13. The bottom fabric cover 19 for the top pillow section provides the cover for the bottom pillow section 15 within which is loosely confined the polyester resilient fibrous filling 41.

In the illustrative embodiment, the compacted resilient fibrous filling 33 may be less compacted than the compacted fibrous filling 31 providing a secondary or supplemental neck support 27 of general U-shape. It is contemplated as equivalent that the compacted fibrous filling 33 within the U-shaped neck support 27 may be compacted so as to be of the same firmness as the primary neck support 29.

The thereapeutic pillow 11 includes a top pillow section 13 within which there are provided firm compacted neck support sections 29, 27 with the entire neck support sections overlying and supported upon the soft fluffy bottom pillow section 15. This provides a soft resilient support for the top pillow section.

Since there is no stuffing between fabric covers 17 and 19 within the central rectangular stitching 23, a headrest 35 defined, which overlies portions of the loosely confined polyester fiber or other resilient fibrous filling 41 to provide a soft comfortable headrest.

Figure 5:
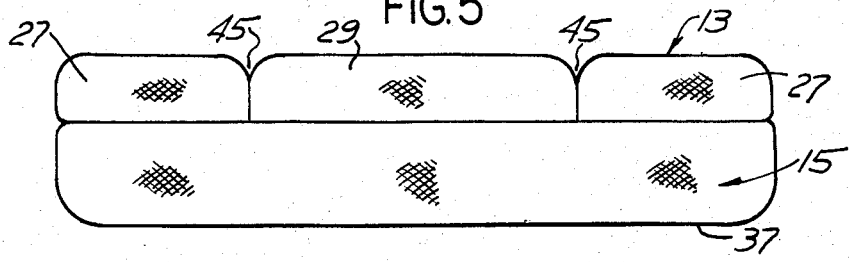
FIG. 5 is a similar view taken in the direction of arrows 5—5 of FIG. 1.

The additional or end stitchings 25, FIG. 1, where they extend from the rectangular stitching 23 out to one edge of the assembled pillow sections provide in the top pillow section the pair of laterally spaced parallel indentations 45, FIGS. 2 and 5.

Said indentations define the primary yieldable but firm tubular neck support 29 for the user when inclined in a horizontal position, with his or her neck resting upon the firm tubular support 39 or alternately upon any portion of the U-shape tubular support 27, and wherein the users head rests upon the central and soft portions of the underlying bottom pillow section.

While the stitching has been shown at 21, 23, 25 and 43, it is contemplated that stitching could be replaced by some other form of securing by which the adjacent portions are interconnected.

It is seen from FIG. 2 that the peripheral side portions of the cover 37 of the bottom section 15 are separately connected to the undersurface portions of the top pillow section by the continuous peripheral stitching 43. The peripheral stitching 21 for the top section is in substantial registry with the peripheral stitching 43 by which the bottom section is connected to the top section of the therapeutic pillow.

As desired, the bottom cover 37 for the bottom pillow section 15 may be similarly ornamented or of a plain cotton or other material.

Having described my invention, reference should not be had to the following claim:

I claim:

1. A therapeutic pillow comprising a soft resilient bottom pillow section;

a top pillow section superimposed thereover and peripherally secured thereto;

the top section including a top fabric cover and an underlying first bottom fabric cover with said covers peripherally interconnected;

continuous rectangular stitching interconnecting said covers and spaced inwardly of the corresponding peripheral connection of said covers;

spaced stitching extensions between said rectangular stitching and one edge of said covers defining a first tubular firm neck support of rectangular shape, exteriorly and transversely convex;

said peripheral connection and rectangular stitching defining a supplemental tubular firm neck support of U-shape, exteriorly and transversely convex;

first compacted stuffing of resilient fibrous material confined and retained within said first neck support;

second compacted stuffing of resilient fibrous material confined and retained within said supplemental neck support;

said bottom section including a second bottom fabric cover generally spaced from and parallel to said first bottom cover and peripherally connected thereto defining a rectangular chamber underlying said top pillow section;

and a loosely confined stuffing of resilient fibrous material enclosed and retained within said chamber yieldably underlying said top pillow section.

2. In the therapeutic pillow of claim 1, said top and first bottom fabric covers within said rectangular stitching being in surface engagement and overlying the bottom pillow section and the stuffing therein defining a soft resilient headrest.

3. In the therapeutic pillow of claim 1, the peripheral connections between said top and bottom fabric covers being continuous stitching;

a peripheral connection between said second bottom cover and top section being continuous stitching.

4. In the therapeutic pillow of claim 3, said first and second stitchings being in registry.

5. In the therapeutic pillow of claim 3, said first and second stitchings being substantially midway of the overall height of said top and bottom pillow sections.

6. In the therapeutic pillow of claim 1, the stuffing in said neck support section being more compacted than the stuffing in said supplemental neck support section.

7. In the therapeutic pillow of claim 1, the height of said first neck support being less than the height of said supplemental neck support.

8. In the therapeutic pillow of claim 1, the height of said neck support and supplemental neck support being substantially uniform.

9. A therapeutic pillow comprising a soft resilient bottom pillow section;

a top pillow section superimposed thereover and peripherally secured thereto;

the top section including a top fabric cover and an underlying first bottom fabric cover with said covers peripherally interconnected;

stitching peripherally interconnecting said covers;

continuous rectangular stitching interconnecting said covers and spaced inwardly of the corresponding peripheral stitching;

spaced stitching extensions between said rectangular stitching and one edge of said covers defining a first tubular neck support of rectangular shape, exteriorly and transversely convex;

said peripheral and rectangular stitching defining a supplemental tubular neck support of U-shape, exteriorly and transversely convex;

first compacted stuffing of resilient fibrous material confined and retained within said first neck support;

second compacted stuffing of resilient fibrous material confined and retained within said supplemental neck support;

said bottom section including a second bottom fabric cover generally spaced from and parallel to said first bottom cover;

stitching peripherally interconnecting said first and second bottom covers defining a rectangular chamber underlying said top pillow section;

and a loosely confined yieldable stuffing of resilient fibrous material enclosed and retained within said chamber underlying said top pillow section.

10. In the therapeutic pillow of claim 1, said resilient stuffing being selected from the group consisting of polyester fiber, cotton, down and feathers.

* * * * *